US011471726B2

(12) United States Patent
Raggio Ulate

(10) Patent No.: US 11,471,726 B2
(45) Date of Patent: Oct. 18, 2022

(54) ELECTRONIC EXERCISE MAT

(71) Applicant: Alberto J. Raggio Ulate, San Antonio, TX (US)

(72) Inventor: Alberto J. Raggio Ulate, San Antonio, TX (US)

( * ) Notice: Subject to any disclaimer, the term of this patent is extended or adjusted under 35 U.S.C. 154(b) by 12 days.

(21) Appl. No.: 17/020,235

(22) Filed: Sep. 14, 2020

(65) Prior Publication Data

US 2021/0077854 A1 Mar. 18, 2021

Related U.S. Application Data

(60) Provisional application No. 62/900,300, filed on Sep. 13, 2019.

(51) Int. Cl.
*A63B 21/00* (2006.01)

(52) U.S. Cl.
CPC ..... *A63B 21/4037* (2015.10); *A63B 2220/56* (2013.01); *A63B 2230/06* (2013.01); *A63B 2230/50* (2013.01)

(58) Field of Classification Search
CPC ..... A63B 21/4037; A63B 2220/56; A63B 2230/06; A63B 2230/50; A63B 2210/50; A63B 2225/20; A63B 2225/50; A63B 2230/00; A63B 6/00; A63B 6/02
See application file for complete search history.

(56) References Cited

U.S. PATENT DOCUMENTS 2,528,768 A 11/1950 Frank
3,222,695 A 12/1965 Brown
8,607,381 B2 12/2013 Woods et al.
8,887,327 B2 11/2014 Davis, Jr.
9,539,463 B1 * 1/2017 Arredondo ..... A63B 71/0622
2004/0250346 A1 * 12/2004 Vasishth ..... A47G 27/0237 5/417
2006/0073305 A1 4/2006 Kole
2016/0332023 A1 * 11/2016 Taylor ..... A47K 10/02
2018/0361193 A1 * 12/2018 Ross ..... A63B 21/4037
2019/0038953 A1 * 2/2019 Bell ..... H05B 47/19

OTHER PUBLICATIONS

Faye Annis, "Why are Papoose Boards Important?", https://blog.universalmedicalinc.com/why-papoose-boards-are-important-for-both-dental-and-medical-procedures/.

* cited by examiner

*Primary Examiner* — Jennifer Robertson

(57) ABSTRACT

An innovative electronic exercise or yoga mat, integrating a T-shaped mat with a cross-shaped mat, allows an instructor and users to see each other in all exercise/yoga postures during an exercise and/or yoga class session. The mat also prevents a user and/or the instructor from having to face sideways, from touching the floor during certain postures, and from having to turn and twist or otherwise moving about the room in order to see one another. The mat provides a structure for incorporating various body inserts and electronic sensors that wirelessly communicate with the user's personal computing (PC) device. Thus, the mat allows the user to customize the desired mat thickness and detects mat pressure and vitals along the entire surface of the mat during an exercise/class session, providing the user with useful and vital information. Further, the mat offers a mechanism rolling up the mat for travel/storage.

18 Claims, 6 Drawing Sheets

ELECTRONIC EXERCISE MAT

The current application claims a priority to the U.S. Provisional Patent application Ser. No. 62/900,300 filed on Sep. 13, 2019. The current application is filed on Sep. 14, 2020 while Sep. 13, 2020 was on a weekend.

FIELD OF THE INVENTION

The present invention relates to exercise mats. The present invention specifically relates to electronic exercise mats, especially yoga mats with integrated T-shaped and cross-shaped extensions that allow an instructor and users to see each other in all exercise/yoga postures. Further, the exercise mats include various sensors that measure the mat pressure and body vitals of a user.

BACKGROUND OF THE INVENTION

The use of a flexible mat that can be rolled out for a user during a yoga or other exercise class and then rolled back up once the class is complete is common. These mats are intended to protect the user from slipping on a supporting surface and/or floor or from otherwise touching or laying on the floor, which can be uncomfortable and unsanitary. Exercise mats, especially yoga mats, are often referred to as "sticky mats" because these mats usually are made with a textured surface that can help prevent slipping on a supporting surface.

Yoga and other exercise mats are typically designed as a straight, elongated strip of material, which creates a number of challenges. For example, because yoga classes often involve a number of poses and stretches that involve various twists and positions, it is inevitable that at some point, users, i.e. students, have to turn to face various sides of the studio in order to stay on the mats, thus resulting in the users not being able to face or otherwise see the instructor during certain poses. For poses that face forward such as Warrior I, Mountain pose, sun salutations, etc., the user and instructor can face one another. However, for a pose that requires the users to turn to the side in order to stay on the mat, for example, a triangle pose, the user and instructor no longer face one another.

If the mats are instead turned the other way, the same problem exists in reverse. In short, no matter which way a traditional yoga or exercise mat is positioned, there will always be some poses where the user and instructor are not facing one another with most existing exercise and/or yoga mats. Even though this problem may be solved by flipping the mats back and forth for the various poses during a class, doing so, however, destroys the class flow, takes time, and is impractical.

In addition to the above problems, the use of straight exercise/yoga mats can also cause various physical strains on the user. If an instructor is demonstrating a posture, and because of the direction of the mat, turns his/her head to view the user's progress, the instructor may strain a neck or back muscle due to the twisted turn. The same problem can happen when the user turns to see the instructor during a pose, which can move the user out of proper and safe body alignment. If, in order to solve the problem, the instructor moves to a different location without a mat, the instructor no longer has the benefits of safety and comfort that the mat offers. And placing multiple mats around the exercise room and/or studio at various positions for the instructor to use during various poses can create a messy, unsafe, and confusing atmosphere.

Further, many studios have hard wood floors. Often, these floors are uncomfortable for certain poses, and some sort of padding would be preferable. Frequently, the user may fold up a blanket to place under knees, ankles, head, elbows or the user doubles up mats, resulting in either the user or the studio having to purchase, maintain, and navigate these additional products. Nonetheless, it has been typically the standard to simply live with these challenges, as there has not been provided a realistic and viable solution.

One attempted solution has been to use two mats, one laid on top of another in a crosswise or opposite direction. However, this solution causes a potential tripping hazard, mat slippage, as well as a bulky and uneven center area where the two mats overlap. This existing solution also requires the purchase of two mats, and having to carry, roll, unroll, and store two mats. If mats are provided by the studio, it requires the studio to maintain double inventory with twice as many mats to store and sanitize. If the user chooses to lay two mats on top of each other in the same direction to create extra padding, similar problems result.

Other solutions have been to provide very large square or oval mats, some as large as six feet across. The size of these mats helps the user stay on the mat during the entire exercise experience, but they are large, expensive, unwieldy to store, and take up a good deal of space in a class, potentially limiting class size. Accordingly, there is still a need in the art for a simple and elegant solution to the above problems.

SUMMARY OF THE INVENTION

The present invention provides an innovative exercise or yoga mat, combining a T-shaped mat with a cross-shaped mat. The use of the present invention in an exercise and/or yoga class situation always allows an instructor and users to see each other, in all exercise/yoga postures. The mat also prevents a user and/or an instructor from having to face sideways during a class, from touching the floor during certain postures, and from having to turn and twist or otherwise moving about the room in order to see one another.

Further, the present invention provides a structure for incorporating and/or changing various body inserts such as foam or electronic sensors that wirelessly communicate with the user's personal computing (PC) device, including, but not limited to, a smartphone, a smart watch, etc. Thus, the present invention allows the user to customize the desired foam thickness of the mat. Additionally, paired with the user's PC device, the mat detects pressure and vitals of the user's body along the entire surface of the mat during an exercise/class session, providing the user with useful and vital information. Further, the electronic exercise mat of the present invention offers an efficient and effective mechanism that allows the user to roll up the mat and carry for travel and/or storage.

DETAIL DESCRIPTIONS OF THE INVENTION

Figure 1:
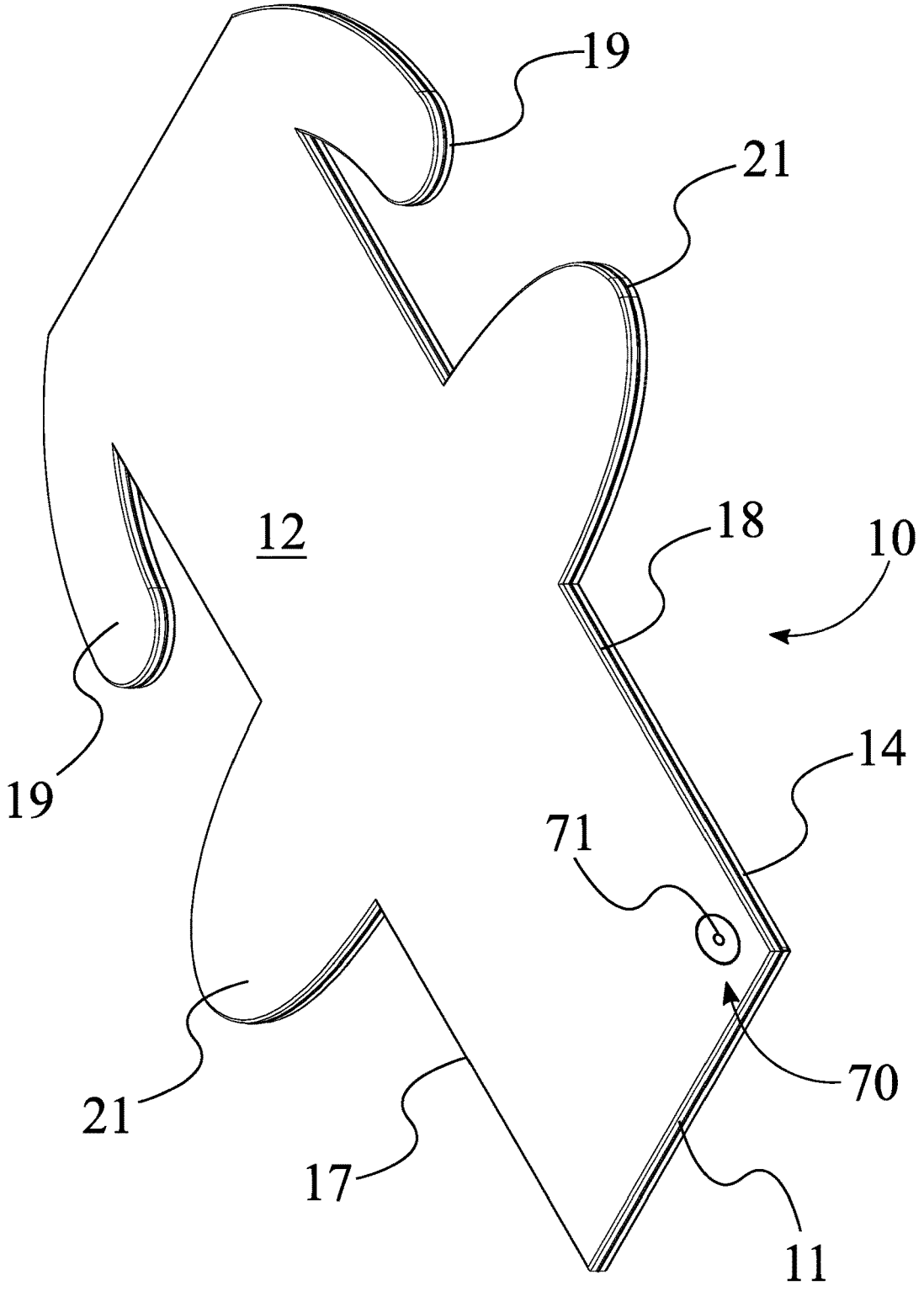
FIG. 1 is a top perspective view of the present invention.

All illustrations of the drawings are for the purpose of describing selected versions of the present invention and are not intended to limit the scope of the present invention.

As can be seen in FIG. 1 to FIG. 6, the present invention is an electronic exercise mat. The electronic exercise mat offers an innovative exercise or yoga mat that integrates a T-shaped and a cross-shaped structure to facilitate front-facing orientation for an instructor and users/participants during the entire duration of a class/exercise session. Thus, the use of the electronic exercise/yoga mat in an exercise/yoga class situation always allows an instructor and a user and/or student to be able to see each other, in all exercise/yoga postures. The electronic exercise mat also prevents the user including the instructor from having to face sideways during class, from touching the floor during certain postures, and from having to turn and twist or otherwise move about the room in order to see one another. Additionally, the electronic exercise mat provides a structure that incorporates various inserts, including, but not limited to, foam, rubber, composite material, etc. Further, the electronic exercise mat can include multiple electronic sensors that are controlled by a processor in the control system and can wirelessly communicate with the user's personal computing (PC) device, including, but not limited to, a smartphone, a smart watch, a tablet, a tablet computer, a cloud computer, a laptop computer, a desktop computer, a server computer, a server terminal, etc. In this embodiment, the user is enabled to customize the desired thickness of the electronic exercise mat of the present invention through any suitable insert. Additionally, paired with the user's PC device, the mat detects vitals of the user's body, including, but not limited to, heart beat, body heat, etc., along with the pressure measurement of the entire surface of the mat during an exercise/class session, providing the user with useful and vital information.

As can be seen in FIG. 1 to FIG. 4, the electronic exercise mat of the present invention comprises a housing 10 and a control system 70. More specifically, the housing 10 comprises a main body 18, a plurality of arms 19, and a plurality of flaps 21. The plurality of arms 19 is distally attached to the longitudinal side of the main body 18, and the plurality of flaps 21 is proximally attached to the longitudinal side of the body 18. Additionally, the control system 70 comprises a processor 71 and a plurality of sensors 73. The plurality of sensors 73 is electrically connected to the processor 71. Further, the control system 70 is mounted to the main body 18 of the housing 10.

As can be seen in FIG. 1 to FIG. 4, the housing 10 provides the entire enclosure of all components of the electronic exercise mat. In the preferred embodiment of the present invention, the housing 10 may take the form of an exercise/yoga mat with cross-shaped and T-shaped extensions that facilitate a wide range of exercise/yoga poses without having the user shift or transform the present invention. Additionally, the housing 10 serves as an enclosed compartment, securing all relevant components inside. The housing 10 comprises a first half 11, a first layer 12, a second layer 13, a second half 14, a third layer 15, a fourth layer 16, a seam mechanism 17, the main body 18, the plurality of arms 19, and the plurality of flaps 21.

As can be seen in FIG. 1 to FIG. 4, the main body 18 of the housing 10 is the central piece of the electronic exercise mat. In the preferred embodiment of the present invention, the main body 18 may take the form of, including, but not limited to, a rectangular shape, an oval shape, or any other suitable shape.

Figure 2:
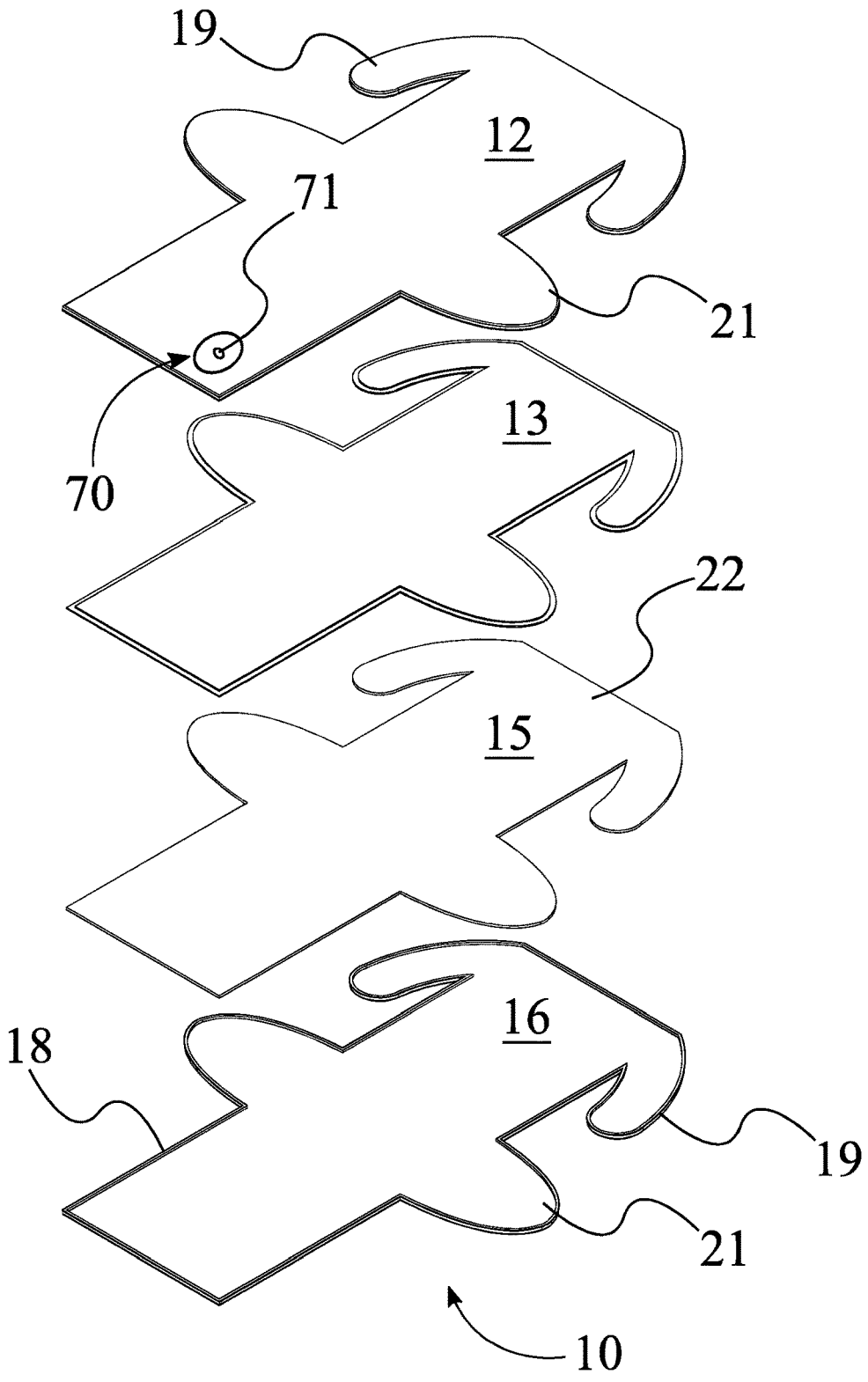
FIG. 2 is an exploded view of the present invention.
Figure 3:
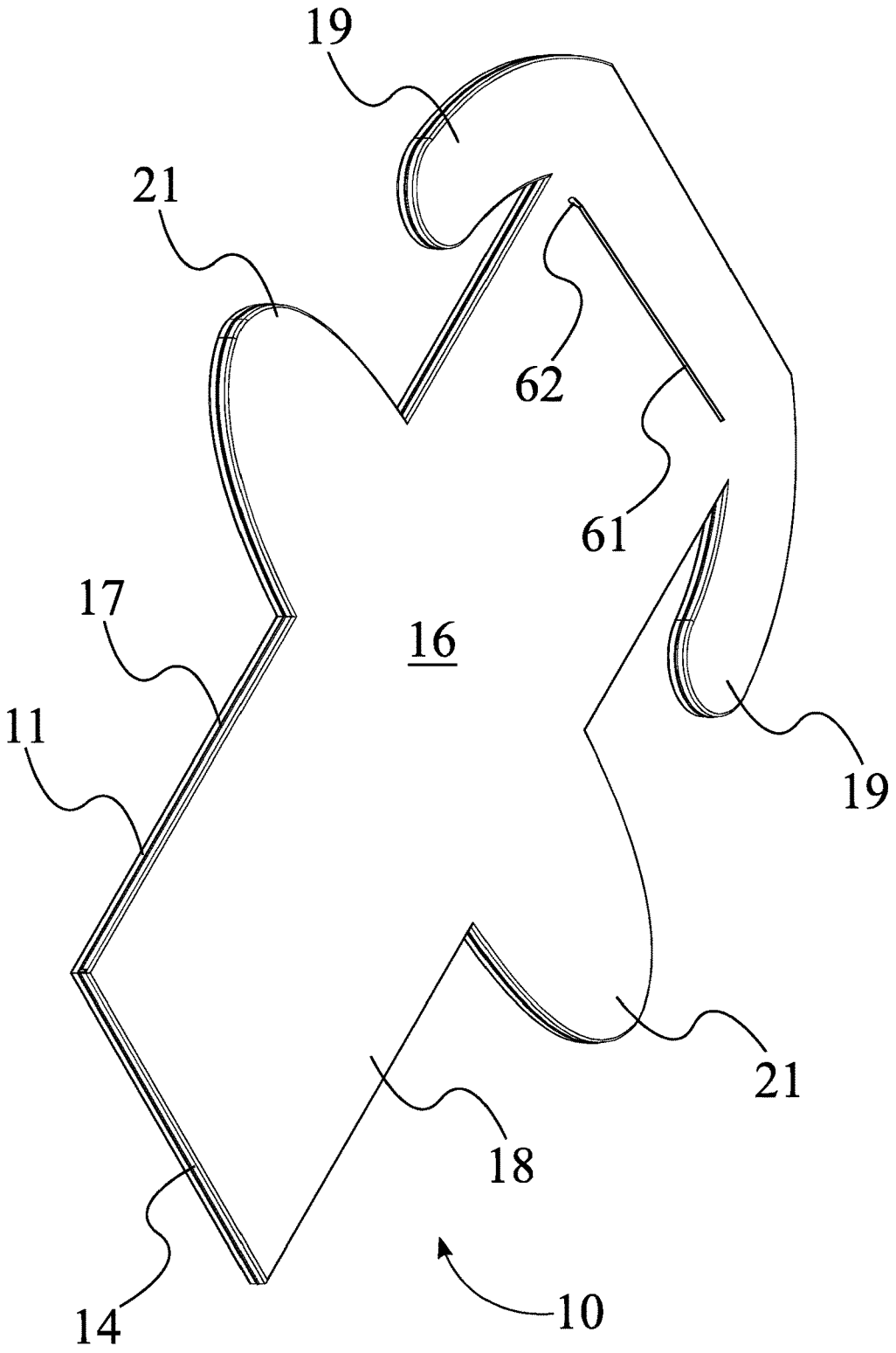
FIG. 3 is a bottom perspective view of the present invention.
Figure 4:
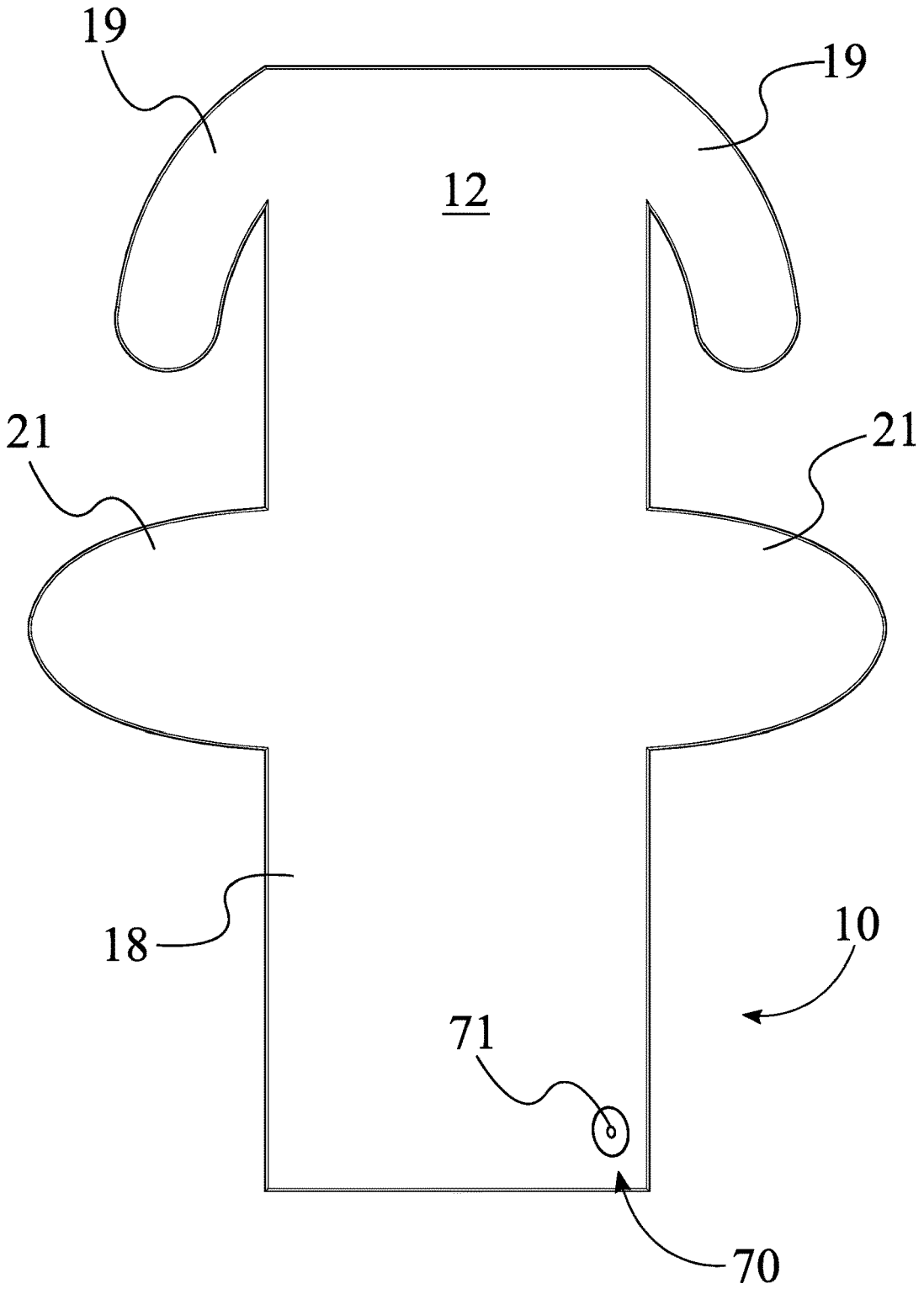
FIG. 4 is a top side view of the present invention.

As can be seen in FIG. 1 to FIG. 3, the second half 14 is removably attached to the housing 10 and is supported by an external surface, including, but not limited to, floor, platform, etc. The first half 11 is removably attached to the housing 10, opposite the second half 14. The seam mechanism 17 is attached to the housing 10. Additionally, the seam mechanism 17 is movably and perimetrically positioned on the interface of the first half 11 and the second half 14. Thus, the first half 11 of the housing 10 and the second half 14 of the housing 10 are removably attached from each other via the seam mechanism 17. In the preferred embodiment of the present invention, the interior portion of the housing 10 is accessible by selectively positioning the seam mechanism 17 to a released state to removably attach the first half 11 to the second half 14 of the housing 10. More specifically, the seam mechanism 17 is perimetrically positioned along the first half 11 and the second half 14 of the housing 10. In the preferred embodiment of the present invention, the seam mechanism 17 may take the form of, including, but not limited to, a zipper fastener, allowing the user to unzip the zipper along the perimeter border of the first half 11 and the second half 14 to access the interior portion of the electronic exercise mat. In various alternative embodiments of the present invention, the seam mechanism 17 can comprise a seam closure fastener, which includes, but is not limited to, any suitable fastening means to selectively position the first half 11 to the second half 14 of the housing, including, but not limited to, magnets, hook and loop fastener, or any other suitable fastening means.

As can be seen in FIG. 1 to FIG. 3, the first half 11 of the housing 10 comprises the first layer 12 and the second layer 13. The first layer 12 is externally positioned to the first half 11. In the preferred embodiment of the present invention, the first layer 12 may take the form of, including, but not limited to, a washable cover which serves as the main surface layer of contact where the user can perform exercise/yoga on. In the other alternative embodiments of the present invention, the first layer 12 may take the form of an anti-slip cover, washable cover, water/sweat absorbent cover, and comfortable surface cover, including, but not limited to, cotton, fabric, or any other suitable material. The second layer 13 is interiorly positioned within the first half 11, opposite the first layer 12. The second layer 13 resides within the first half 11 of the housing 10. In the preferred embodiment of the present invention, the second layer 13 may take the form of an electronic panel including, but not limited to, an electronic fiber panel, an electronics sensory fiber panel, which electrically wires and secures all electronic components of the electronic exercise mat. The control system 70 is securely mounted on the electronic panel within the second layer 13.

As can be seen in FIG. 1 to FIG. 3, the second half 14 of the housing 10 comprises the third layer 15 and the fourth layer 16. The third layer 15 is interiorly positioned within the second half 14, opposite the first half 11 and the fourth layer 16 is exteriorly positioned on the second half 14, opposite the third layer 15. More specifically, the third layer 15 resides within the second half 14 of the housing 10. In the preferred embodiment of the present invention, the third layer 15 may include, but is not limited to, a foam padding insert. Additionally, the third layer 15 may comprise at least one body insert 22, which incudes, but not limited to, foam of various thicknesses and/or densities, or any other suitable material. The fourth layer 16 is externally connected to the second half 14. In the preferred embodiment of the present invention, the fourth layer 16 may include, but is not limited to, a textured cover, an anti-slip layer that secures the electronic yoga mat on a support surface, including, but not limited to, floor, platform, and any other suitable surface.

As can be seen in FIG. 2 to FIG. 3, in the preferred embodiment of the present invention, the second half 14 of the electronic exercise mat comprises an opening 61 and a fastener 62. The opening 61 is terminally positioned on the second half 14, opposite the first half 11. More specifically, the opening 61 is positioned on the fourth layer 16 of the second half 14. The fastener 62 is movably and perimetrically positioned on the opening 61, which can be used to close or open the opening 61 in order to replace the at least one body insert 22. The housing 10 may comprise the at least one body insert 22, which is interiorly positioned within the main body 18. The at least one body insert 22 is configured inside the main body 18 through the opening 51 on the fourth layer 16. The at least one body insert 22 allows the user to swap the third layer 15 with inserts of varying thickness to achieve desired exercise mat of the present invention. In the preferred embodiment of the present invention, the third layer 15 may take the form of a rubber layer of varying thickness along a horizontal cross section, but can take form of any type of material and thickness.

As can be seen in FIG. 1 to FIG. 4, the plurality of arms 19 is connected to the longitudinal end of the main body 18 of the housing 10. More specifically, the plurality of arms 19 is positioned laterally from the longitudinal end of the main body 18. In the preferred embodiment of the present invention, the plurality of arms 19 may take the form of arced extensions that gives the electronic exercise mat a T-shaped orientation, which, for example, may be used to efficiently and comfortably support the user's arms.

As can be seen in FIG. 1 to FIG. 4, the plurality of flaps 21 is connected to the main body 18 of the housing 10. More specifically, the plurality of flaps 21 is positioned laterally from the longitudinal length of the main body 18, distal from the plurality of arms 19. In the preferred embodiment of the present invention, the plurality of flaps 21 may take the form of broad extensions that gives the electronic exercise mat a cross-shaped orientation, providing extended overall width for supporting the user's knees and legs for positions that require such positioning during exercise/yoga session, class, etc.

Figure 5:
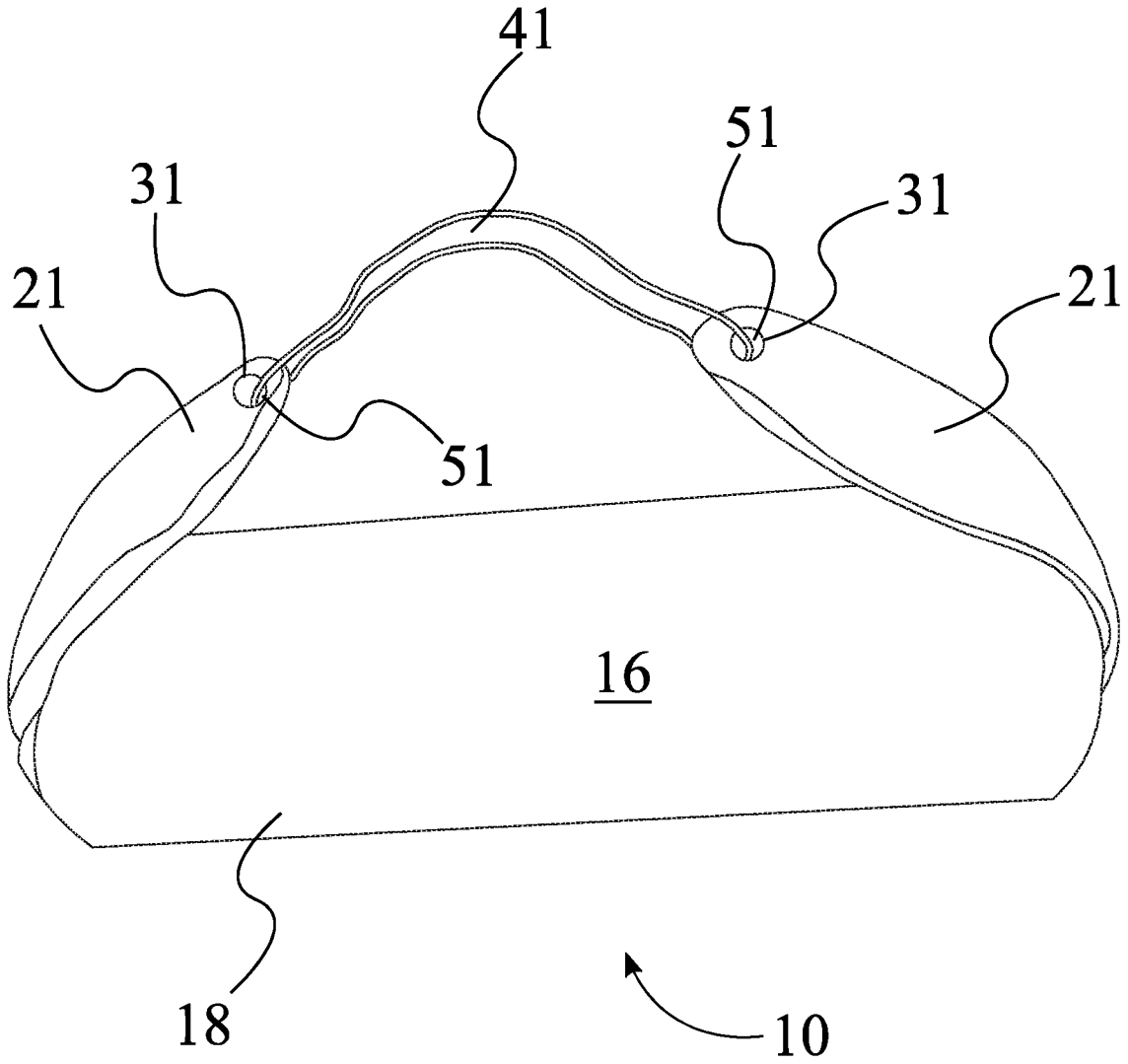
FIG. 5 is a front perspective view of the present invention in a rolled-up configuration.

As can be seen in FIG. 5, the electronic exercise mat can comprise a plurality of loops 31, a handle 41, and at least one clasp 51. Each of the plurality of loops 31 is distally positioned on one of the plurality of flaps 21. The handle 41 is detachably attached to the plurality of loops 31. The at least one clasp 51 is distally attached to the handle 41 and is configured to selectively detach the handle 41 from the plurality of loops 31. More specifically, the plurality of loops 31 is positioned along the plurality of flaps 21. The plurality of loops 31 may include, but is not limited to, openings, buttons, etc., to allow the user to removably attach the handle 41 along the plurality of loops 31. The handle 41 is positioned to the plurality of loops 31 and may include, but is not limited to, strap, string, belt, or any suitable carrying handle, which allows the user to ergonomically carry the electronic exercise mat in a rolled up configuration, including, but not limited to, carrying bag, backpack, handbag, etc. Further, the at least one clasp 51 is positioned along the ends of the handle 41, connected to the plurality of loops 31. The at least one clasp 51 may take the form of any suitable quick-detach fastener that allows the user to selectively detach the handle 41 from the plurality of loops 31 to deploy the electronic exercise mat of the present invention.

As can be seen in FIG. 1 to FIG. 2, FIG. 4, and FIG. 6, the control system 70 of the electronic exercise mat comprises the processor 71, a power source 72, the plurality of sensors 73, a wireless device 74, and a user interface 75. The processor 71 is electrically connected to the power source 72. The user interface 75 and the wireless device 74 are electrically connected to the processor 71. The wireless device 74 is connected to an external personal computing (PC) device through a wireless communication network. More specifically, the processor 71 is operatively connected to the second layer 13 of the housing 10 and serves as the main computer control unit of the control system 70 that operatively engages all electronic components of the electronic exercise mat. The power source 72 is connected with and used to provide electrical power to the processor 71. The power source 72 distributes electrical power to all other electronic components of the control system 70 of the electronic exercise mat. In the preferred embodiment of the present invention, the power source 72 may take the form any cordless, corded, or combination thereof, including, but not limited to, battery, rechargeable battery, USB power cord, or any other suitable means. The plurality of sensors 73 is directed and distributed along the main body 18, the plurality of arms 19, and the plurality of flaps 21 of the housing 10. More specifically, the plurality of sensors 73 is connected to the processor 71 and positioned on the first half 11 of the housing 10. In the preferred embodiment of the present invention, the plurality of sensors 73 may comprise at least one pressure sensor that measures the amount of pressure applied on specific portions of the electronic exercise mat. Additionally, the electronic exercise mat can comprise sensors that measure the user's vitals, including, but not limited to, body heat, heart beat, or any other suitable vitals. Thus, the plurality of sensors 73 may comprise at least one heart beat sensor, at least one body heat sensor, etc.

Figure 6:
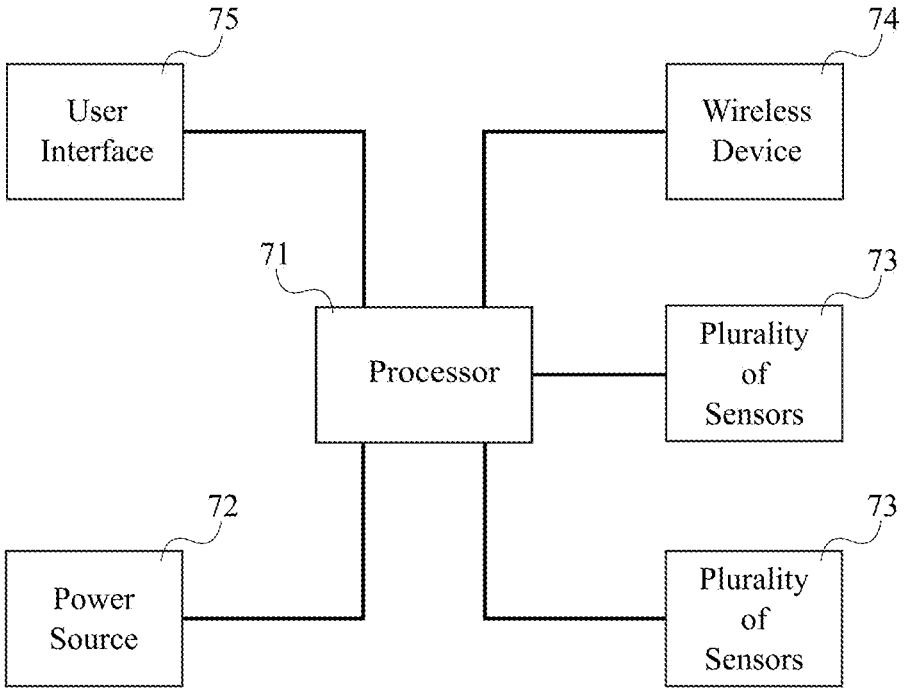
FIG. 6 is a circuit diagram of the present invention.

As can be seen in FIG. 6, the wireless device 74 is connected to the processor 71. The wireless device 74 transmits data received from the plurality of sensors 73 over to the user interface 75, or any suitable exterior PC device of the user. In the preferred embodiment of the present invention, the wireless device 74 may take the form of a Bluetooth module, or any other suitable device. The user interface 75 is connected to the processor 71. The user interface 75 serves as the user dashboard and/or interaction panel to display the pressure and vital information recorded by the plurality of sensors 73. In the preferred embodiment of the present invention, the user interface 75 may be installed on the control system 70, or take the form of a suitable remote device such as the exterior PC device of the user.

Although the invention has been explained in relation to its preferred embodiment, it is to be understood that many other possible modifications and variations can be made without departing from the spirit and scope of the invention as hereinafter claimed.

What is claimed is:

1. An electronic exercise mat with an integrated T-shaped and cross-shaped structure comprising:

a housing;

a control system;

the housing comprising a first half, a second half, a seam mechanism, a main body, a plurality of arms, and a plurality of flaps;

the plurality of arms being distally attached to the longitudinal side of the main body;

the plurality of flaps being proximally attached to the longitudinal side of the main body;

the control system comprising a processor and a plurality of sensors;

the plurality of sensors being electrically connected to the processor;

the control system being mounted to the main body of the housing;

the second half being removably attached to the first half, supported by an external surface;

the first half being opposite the second half;

the seam mechanism being attached to the first half and the second half;

the seam mechanism being movably and perimetrically positioned on the interface of the first half and the second half;

the second half comprising an opening and a fastener;

the opening being terminally positioned on the second half, opposite the first half; and the fastener being movably and perimetrically positioned on the opening.

2. The electronic exercise mat with an integrated T-shaped and cross-shaped structure as claimed in claim 1 comprising:

the control system comprising a power source, a user interface, and a wireless device;

the processor being electrically connected to the power source;

the user interface being electrically connected to the processor;

the wireless device being electrically connected to the processor; and the wireless device being connected to an external personal computing device through a wireless communication network.

3. The electronic exercise mat with an integrated T-shaped and cross-shaped structure as claimed in claim 1 comprising:

the plurality of sensors comprising at least one pressure sensor.

4. The electronic exercise mat with an integrated T-shaped and cross-shaped structure as claimed in claim 1 comprising:

the plurality of sensors comprising at least one heart beat sensor.

5. The electronic exercise mat with an integrated T-shaped and cross-shaped structure as claimed in claim 1 comprising:

the plurality of sensors comprising at least one body heat sensor.

6. The electronic exercise mat with an integrated T-shaped and cross-shaped structure as claimed in claim 1 comprising:

the plurality of arms comprising the form of arced extensions providing a T-shaped orientation.

7. The electronic exercise mat with an integrated T-shaped and cross-shaped structure as claimed in claim 1 comprising:

the plurality of flaps comprising the form of broad extensions providing a cross-shaped orientation.

8. The electronic exercise mat with an integrated T-shaped and cross-shaped structure as claimed in claim 1 comprising:

the seam mechanism comprising a seam closure fastener.

9. The electronic exercise mat with an integrated T-shaped and cross-shaped structure as claimed in claim 1 comprising:

the housing comprising at least one body insert;

the at least one body insert being interiorly positioned within the main body; and the at least one body insert being configured inside the main body through the opening.

10. The electronic exercise mat with an integrated T-shaped and cross-shaped structure as claimed in claim 1 comprising:

the housing comprising a plurality of loops, a handle, and at least one clasp;

each of the plurality of loops being distally positioned on one of the plurality of flaps;

the handle being detachably attached to the plurality of loops;

the at least one clasp being distally attached to the handle; and the at least one clasp being configured to selectively detach the handle from the plurality of loops.

11. The electronic exercise mat with an integrated T-shaped and cross-shaped structure as claimed in claim 10 comprising:

the at least one clasp comprising a quick-detach fastener.

12. An electronic exercise mat with an integrated T-shaped and cross-shaped structure comprising:

a housing;

a control system;

the housing comprising a first half, a second half, a seam mechanism, a main body, a plurality of arms, and a plurality of flaps;

the plurality of arms being distally attached to the longitudinal side of the main body;

the plurality of flaps being proximally attached to the longitudinal side of the main body;

the control system comprising a processor and a plurality of sensors;

the plurality of sensors being electrically connected to the processor;

the control system being mounted to the main body of the housing;

the second half being removably attached to the first half, supported by an external surface;

the first half being opposite the second half;

the seam mechanism being attached to the first half and the second half;

the seam mechanism being movably and perimetrically positioned on the interface of the first half and the second half;

the first half comprising a first layer and a second layer;

the first layer being exteriorly positioned on the first half;

the second layer being interiorly positioned within the first half, opposite the first layer;

the second half comprising a third layer and a fourth layer;

the third layer being interiorly positioned within the second half, opposite the first half; and the fourth layer being exteriorly positioned on the second half, opposite the third layer.

13. The electronic exercise mat with an integrated T-shaped and cross-shaped structure as claimed in claim 12 comprising:

the first layer of the first half comprising a washable cover.

14. The electronic exercise mat with an integrated T-shaped and cross-shaped structure as claimed in claim 12 comprising:

the first layer of the first half comprising an anti-slip cover.

15. The electronic exercise mat with an integrated T-shaped and cross-shaped structure as claimed in claim 12 comprising:

the first layer of the first half comprising a water absorbent cover.

16. The electronic exercise mat with an integrated T-shaped and cross-shaped structure as claimed in claim 12 comprising:

the second layer of the first half comprising an electronic panel; and the control system being mounted on the electronic panel.

17. The electronic exercise mat with an integrated T-shaped and cross-shaped structure as claimed in claim 12 comprising:

the third layer of the second half comprising at least one body insert.

18. The electronic exercise mat with an integrated T-shaped and cross-shaped structure as claimed in claim 12 comprising:

the fourth layer of the second half comprising an anti-slip layer.

* * * * *